US005399470A

United States Patent [19]

Dickerson et al.

[11] Patent Number: 5,399,470

[45] Date of Patent: Mar. 21, 1995

[54] MINIMAL CROSSOVER RADIOGRAPHIC ELEMENTS AND ASSEMBLIES ADAPTED FOR FLESH AND BONE IMAGING

[75] Inventors: Robert E. Dickerson; Phillip C. Bunch, both of Rochester, N.Y.

[73] Assignee: Eastman Kodak Company, Rochester, N.Y.

[21] Appl. No.: 192,082

[22] Filed: Feb. 4, 1994

Related U.S. Application Data

[63] Continuation of Ser. No. 14,607, Feb. 8, 1993, abandoned, which is a continuation of Ser. No. 746,867, Aug. 16, 1991, abandoned.

[51] Int. Cl.[6] ..... G03C 1/08

[52] U.S. Cl. ..... 430/509; 430/139; 430/966; 430/502; 430/496; 430/507

[58] Field of Search ..... 430/509, 139, 966, 502, 430/496, 507

[56] References Cited

U.S. PATENT DOCUMENTS

| | | | |
|---|---|---|---|
| H1,105 | 9/1992 | Jebo et al. | 430/502 |
| 4,425,425 | 1/1984 | Abbott et al. | 430/502 |
| 4,425,426 | 1/1984 | Abbott et al. | 430/502 |
| 4,803,150 | 2/1989 | Dickerson et al. | 430/502 |
| 4,900,652 | 2/1990 | Dickerson et al. | 430/502 |
| 4,994,355 | 2/1991 | Dickerson et al. | 430/509 |
| 4,997,750 | 3/1991 | Dickerson et al. | 430/509 |
| 5,021,327 | 6/1991 | Bunch et al. | 430/502 |
| 5,079,134 | 1/1992 | Toya | 430/502 |
| 5,108,881 | 4/1992 | Dickerson et al. | 430/502 |
| 5,252,443 | 10/1993 | Dickerson | 430/502 |
| 5,268,251 | 12/1993 | Sakuma | 430/502 |

FOREIGN PATENT DOCUMENTS

| | | | |
|---|---|---|---|
| 530129 | 7/1954 | Belgium . | |
| 0126644 | 11/1984 | European Pat. Off. . | |
| 0437117 | 7/1991 | European Pat. Off. | 430/502 |
| 1017464 | 4/1955 | Germany . | |

OTHER PUBLICATIONS

U.S. Statutory Invention Registration H1105, Sep. 1992, Jebo et al.

*Research Disclosure,* vol. 184, Aug. 1979, Item 18431, Section V.: Cross-Over Exposure Control.

*Primary Examiner*—Thomas R. Neville

*Attorney, Agent, or Firm*—Anne B. Kiernan

[57] ABSTRACT

Radiographic elements and assemblies are disclosed. The radiographic element has silver halide emulsion layer units coated on opposite sides of a film support, and are constructed to minimize crossover during exposure by the intensifying screens. The minimal crossover radiographic elements record both bone and soft tissue structure because a silver halide emulsion layer unit on one side of the support is chosen to exhibit an emission and contrast exceeding that of another silver halide emulsion layer unit on the opposite side of the support. Radiographic assemblies consisting of the radiographic elements and various front and back intensifying screens produce clear and useful X-ray images of the various bones and surrounding soft tissue structures of the body.

22 Claims, 8 Drawing Sheets

MINIMAL CROSSOVER RADIOGRAPHIC ELEMENTS AND ASSEMBLIES ADAPTED FOR FLESH AND BONE IMAGING

This is a continuation of commonly assigned U.S. Ser. No. 08/014,607, now abandoned, filed Feb. 8, 1993, titled MIMINAL CROSSOVER RADIOGRAPHIC ELEMENTS ADAPTED FOR FLESH AND BONE IMAGING, which is a continuation of U.S. Ser. No. 07/746,867, filed Aug. 16, 1991, now abandoned, possessing the same title.

FIELD OF THE DISCLOSURE

The invention relates to radiographic imaging. More specifically, the invention relates to radiographic elements comprising double coated silver halide radiographic elements, and assemblies of radiographic elements with intensifying screens.

DEFINITION OF TERMS

The term "double coated" as applied to a radiographic element means that emulsion layer units, also referred to as emulsion layers, are coated on each of the two opposite sides of the support.

The term "low crossover" as applied to double coated radiographic elements indicates a crossover of less than 10% within the wavelength range of imaging and when measured as more fully described below.

The term "Modulation Transfer Function" or "MTF" is a measure of the image blur and can be computed from the ratio of the output amplitude to input amplitude when the incident x-ray pattern is a sinusoidal signal.

The term "sensitometrically symmetric" means that the emulsion layer units on opposite sides of a double coated radiographic element produce identical characteristic curves when identically exposed.

The term "sensitometrically asymmetric" means that the emulsion layer units on opposite sides of a double coated radiographic element produce significantly different characteristic curves when identically exposed.

BACKGROUND

In medical radiography an image of a patient's tissue and bone structure is produced by exposing the patient to X-radiation and recording the pattern of penetrating X-radiation using a radiographic element containing at least one radiation-sensitive silver halide emulsion layer coated on a transparent (usually blue tinted) film support. The X-radiation can be directly recorded by the emulsion layer where only limited areas of exposure are required, as in dental imaging and the imaging of body extremities. However, a more efficient approach, which greatly reduces X-radiation exposures, is to employ an intensifying screen in combination with the radiographic element. The intensifying screen absorbs X-radiation and emits longer wavelength electromagnetic radiation which silver halide emulsions more readily absorb. Another technique for reducing patient exposure is to coat two silver halide emulsion layers on opposite sides of the film support to form a "double coated" radiographic element.

Diagnostic needs can be satisfied at the lowest patient X-radiation exposure levels by employing a double coated radiographic element in combination with a pair of intensifying screens. The silver halide emulsion layer unit on each side of the support directly absorbs about 1 to 2 percent of incident X-radiation. The front screen, the screen nearest the X-radiation source, absorbs a much higher percentage of X-radiation, but still transmits sufficient X-radiation to expose the back screen, the screen farthest from the X-radiation source.

An imagewise exposed double coated radiographic element contains a latent image in each of the two silver halide emulsion layer units on opposite sides of the film support. Processing converts the latent images to silver images and concurrently fixes out undeveloped silver halide, rendering the film light insensitive. When the film is mounted on a view box, the two superimposed silver images on opposite sides of the support are seen as a single image against a white, illuminated background.

An art recognized difficulty with employing double coated radiographic elements in combination with intensifying screens as described above is that some light emitted by each screen passes through the transparent film support to expose the silver halide emulsion layer unit on the opposite side of the support. The light emitted by a screen that exposes the emulsion layer unit on the opposite side of the support reduces image sharpness. The effect is referred to in the art as crossover.

A variety of approaches have been suggested to reduce crossover, as illustrated by *Research Disclosure,* Vol. 184, August 1979, Item 18431, Section V. Cross-Over Exposure Control. *Research Disclosure* is published by Kenneth Mason Publications, Ltd., Dudley Annex, 21a North Street, Emsworth, Hampshire P010 7DQ, England. While some of these approaches are capable of entirely eliminating crossover, they either interfere with (typically entirely prevent) concurrent viewing of the superimposed silver images on opposite sides of the support as a single image, require separation and tedious manual reregistration of the silver images in the course of eliminating the crossover reduction medium, or significantly desensitize the silver halide emulsion. As a result, none of these crossover reduction approaches have come into common usage in the radiographic art. An example of a recent crossover cure teaching of this type is Bollen et al, European published patent application 276,497, which interposes a reflective support between the emulsion layer units during imaging.

The most successful approach to crossover reduction yet realized by the art consistent with viewing the superimposed silver images through a transparent film support without manual registration of images has been to employ double coated radiographic elements containing spectrally sensitized high aspect ratio tabular grain emulsions or thin intermediate aspect ratio tabular grain emulsions, illustrated by Abbott et al, U.S. Pat. Nos. 4,425,425 and 4,425,426, respectively. Whereas radiographic elements typically exhibited crossover levels of at least 25 percent prior to Abbott et al, Abbott et al provide examples of crossover reductions in the 15 to 22 percent range.

Still more recently Dickerson et al, U.S. Pat. No. 4,803,150, hereinafter referred to as Dickerson et al I, has demonstrated that by combining the teachings of Abbott et al with a processing solution decolorizable microcrystalline dye located between at least one of the emulsion layer units and the transparent film support "zero" crossover levels can be realized. Since the technique used to determine crossover (single screen exposure of a double coated radiographic element) cannot distinguish between exposure of the emulsion layer unit on the side of the support remote from the screen caused by crossover and the exposure caused by direct absorption of X-radiation, "zero" crossover radiographic elements in reality embrace radiographic elements with a measured crossover (including direct X-ray absorption) of less than about 5 percent.

Dickerson et al, U.S. Patent 4,900,652, hereinafter referred to as Dickerson et al II, adds to the teachings of Dickerson et al I, cited above, specific selections of hydrophilic colloid coating coverage in the emulsion and dye containing layers to allow the "zero" crossover radiographic elements to emerge dry to the touch from a conventional rapid access processor in less than 90 seconds with the crossover reducing microcrystalline dye decolorized.

Dickerson and Bunch, U.S. Pat. No. 4,997,750 (hereinafter Dickerson and Bunch I) discloses low crossover double coated radiographic elements in which the emulsion layer units on opposite sides of the support differ in speed.

Dickerson and Bunch, U.S. Pat. No. 4,994,355 (hereinafter Dickerson and Bunch II) discloses low crossover double coated radiographic elements in which the emulsion layer units on opposite sides of the support differ in contrast.

Bunch and Dickerson, U.S. Pat. No. 5,021,327 discloses low crossover double coated radiographic elements in combination with a pair of intensifying screens, where the back emulsion layer unit-intensifying screen combination exhibits a photicity twice that of the front emulsion layer unit-intensifying screen combination.

Dickerson and Bunch I and II as well as Bunch and Dickerson disclose a low crossover double coated radiographic element having a fast low contrast emulsion layer unit on one side of the support and a slow high contrast emulsion layer unit on the opposite side of the support.

Jebo et al, Statutory Invention Registration H1105 discloses low crossover double coated radiographic elements with emulsion layer units on opposite sides of the support that differ in sensitometric properties. A feature is included for ascertaining which of the emulsion layer units is positioned nearest a source of X-radiation during exposure.

Dickerson and Bunch, U.S. Pat. No. 5,108,881 discloses a low crossover radiographic element in which a faster silver halide emulsion layer unit coated on one side of the support exhibits a lower contrast than a slower silver halide emulsion layer unit coated on the opposite side of the support.

Radiographic elements that produce higher contrast images at lower densities and lower contrast images at higher densities are disclosed by Suzuki et al, published European Patent Application 0 126 644 and Belgian Pat. No. 530,129, issued Jul. 31, 1954. Suzuki et al blended emulsions to achieve this result while the Belgian Patent suggests coating higher and lower contrast emulsions on the opposite sides of a support.

Sensitometric Features

Figure 2:
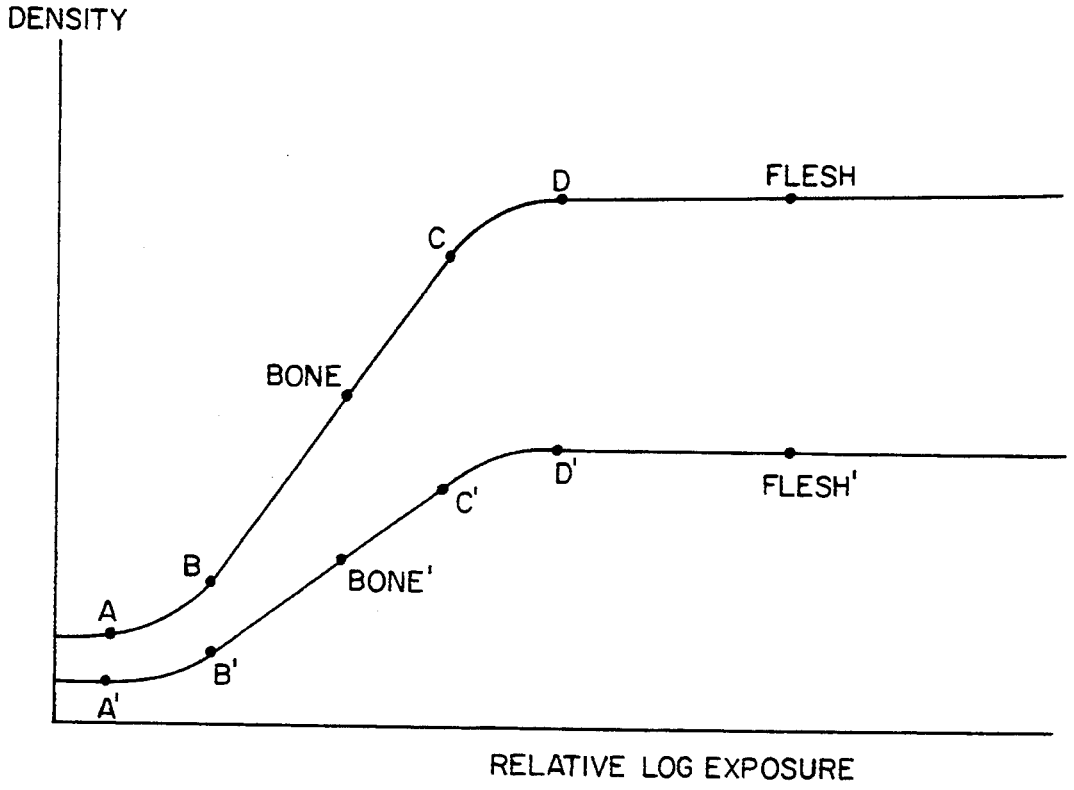
FIG. 2 illustrates the overall sensitometric characteristic curve of a conventional sensitometrically symmetric double coated radiographic element and the characteristic curve of each of two identical individual emulsion layer units forming the radiographic element.
Figure 3:
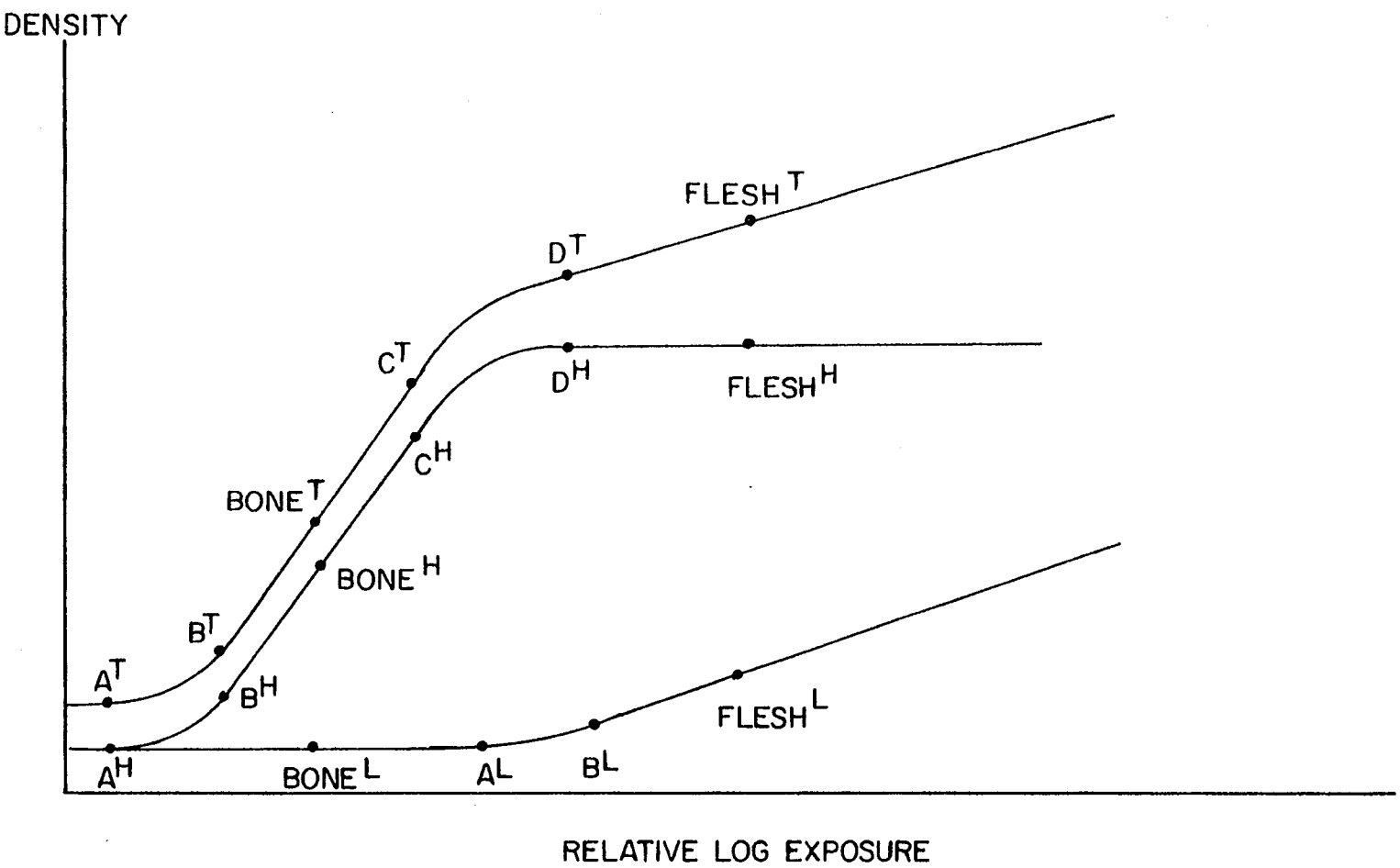
FIG. 3 illustrates the overall sensitometric characteristic curve of a sensitometrically asymmetric low crossover double coated radiographic element according to the invention and the characteristic curves of the individual emulsion layer units as positioned by their screen exposures.

For ease of visualization, the characteristic curves of FIGS. 2 and 3 have been drawn to conform to an ideal configuration. Ignoring superscripts, which are employed to distinguish one curve from another, the points A, B, C and D indicate corresponding reference points in the curves. A is the point beyond which additional exposure results in an increase in density—that is, A is the highest exposure level consistent with obtaining minimum density (Dmin). The curve segment A-B is in each instance the toe of the characteristic curve. In the toe of a characteristic curve, incremental increases in density become larger with each incremental increase in the logarithm of exposure. The curve segments B-C are shown as linear—that is, as regions in which each incremental increase in the logarithm of exposure produces a corresponding incremental increase in density. In this region contrast or $\gamma$, the ratio of $\Delta D/\Delta \log E$, remains constant. In practice the mid-scale portion of a characteristic curve is rarely truly linear, and the $\Delta D/\Delta \log E$ interval used to calculate average contrast is usually based on characteristic curve points at arbitrarily selected low and high density values. The curve segment C-D is the shoulder of the characteristic curve. In this region each incremental increase in the logarithm of exposure produces a smaller increase in density than that which preceded. Exposure beyond point D produces no further increase in density. Therefore point D lies at maximum density (Dmax). BONE and FLESH indicate the general locations that exposures penetrating these tissue would be located, based on exposure assumptions described in detail below.

The Problem to be Solved

In radiographic imaging sharp images of bone tissue are required to pick up hairline fractures and trabecular detail. Obtaining sharp bone images requires relatively high contrasts.

It is, in many instances, highly desirable to be able to see the soft tissue, for example, muscles, skin, cartilage and tendons, also referred to as flesh, surrounding the bones in a radiographic image. Achieving both bone and soft tissue imaging in a single radiograph is difficult if not impossible using conventional radiographic elements. The reason is that when film exposure has been optimized for bone imaging the film is receiving about 0.6 log E (subject to some patient-to-patient variation) more exposure in areas in which the exposing X-radiation has penetrated only flesh. Given the requirement of relatively sharp images for bone feature definition, contrast levels are too high to provide film exposure latitude sufficient to capture both bone and flesh features in a single image. In other words, in a conventional radiographic image once a properly exposed image of bone has been obtained, the surrounding areas, whether soft tissue is present or absent, are all at or approaching maximum density and are accordingly recorded with very low contrast. Surrounding soft tissue is too dark on the film or barely perceptible under standard light box illumination.

In addition, because there are bones surrounded by different densities of soft tissue in the body, such as, the small bones in the hands with only a small amount of soft tissue coverage, the knees and shoulders with large amounts of soft tissue coverage and the lateral cervical spine which has very little tissue coverage in the neck and great amounts in the shoulder region, there is a need for optimum X-ray imaging for the various combinations of bones and soft tissue in the body.

BRIEF SUMMARY OF THE INVENTION

The present invention has as its purpose to provide radiographic elements that exhibit the sharp imaging advantages of low crossover radiographic elements, allowing optimum sharp imaging of bone tissue while at the same time obtaining functionally serviceable images of surround flesh, and to provide radiographic assemblies comprising the low crossover radiographic elements and various pairs of front and back intensifying screens to optimize the imaging results for the various bones and soft tissue of the body.

In one aspect, this invention is directed to a radiographic element comprised of a transparent film support, first and second silver halide emulsion layer units coated on opposite sides of the film support, and means for reducing to less than 10 percent crossover of electromagnetic radiation of wavelengths longer than 300 nm capable of forming a latent image in the silver halide emulsion layer units, the crossover reducing means being decolorized in less than 30 seconds during processing of the emulsion layer units.

The radiographic element is characterized in that, at a density of 1.0, the back silver halide emulsion layer unit exhibits a speed exceeding by from 0.3 to 1.0 log E that of the front silver halide emulsion layer unit, the back silver halide emulsion layer unit exhibiting a contrast in the range of from 2.0 to 4.0, and the front silver halide emulsion layer unit exhibiting a contrast in the range of from 0.5to 1.7.

In another aspect, this invention is directed to radiographic assemblies comprising the low crossover sensitometrically asymmetric radiographic element and front and back intensifying screens.

The front and back intensifying screens in the imaging assemblies vary according to the bone structure and the densities of the surrounding soft tissue being imaged. In the assemblies, the front intensifying screen is next to and/or in contact with the front silver halide emulsion layer unit and the back intensifying screen is next to and/or in contact with the back silver halide emulsion layer unit. The front intensifying screen is preferably the screen closest to the X-ray source. If an X-ray image of bone(s) with minimal soft tissue coverage such as an extremity is sought, then the front and back intensifying screens in the assembly are high resolution intensifying screens. If an X-ray image of bone(s) with more soft tissue coverage than an extremity is sought, such as a knee or shoulder, then the front screen is high resolution intensifying screen, and the back is a medium resolution intensifying screen. If a single X-ray image of bone(s) that are surrounded by a great amount of soft tissue and also a small amount of soft tissue, such as a lateral C-spine, is sought, then the front screen is a high resolution intensifying screen and the back screen is a low resolution, often called high speed, intensifying screen. These assemblies optimize the images captured on the low crossover radiographic element for orthopedic imaging providing radiologists with detailed images of bones and useful images of the surrounding soft tissue.

DESCRIPTION OF THE PREFERRED EMBODIMENTS

The present invention constitutes an improvement over low crossover double coated radiographic elements, such as, for example, those disclosed by Dickerson et al I and II, the disclosures of which are herein incorporated by reference. The advantages of the present invention are that, in addition to improved image sharpness attributable to low crossover, the radiographic elements are also capable of producing both sharp images of bone and useful images of surrounding soft tissue (i.e., flesh) exhibiting a much lower capability of attenuating X-radiation. Another advantage is that the assemblies consisting of the low crossover radiographic elements with varying front and back intensifying screens can optimize the x-ray images for the various bones and soft tissue structures in the body.

Figure 1:
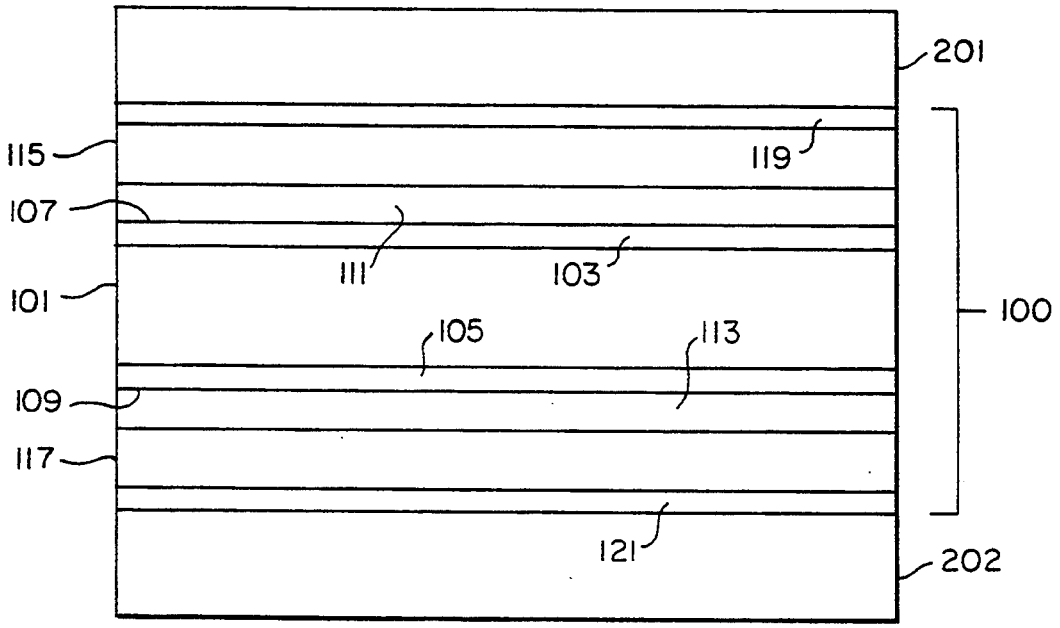
FIG. 1 is a schematic diagram of an assembly consisting of a low crossover radiographic element sandwiched between two intensifying screens.

The imaging characteristics of low crossover double coated radiographic elements can be appreciated by referring to FIG. 1. In the assembly shown a low crossover double coated radiographic element 100 is positioned between a pair of light emitting intensifying screens 201 and 202. The radiographic element support is comprised of a transparent radiographic support element 101, typically blue tinted, capable of transmitting light to which it is exposed and, optionally, similarly transmissive subbing units 103 and 105. On the back and front opposed major faces 107 and 109 of the support formed by the subbing units are crossover reducing hydrophilic colloid layers 111 and 113, respectively. Overlying the crossover reducing layers 111 and 113 are light recording latent image forming silver halide emulsion layer units 115 and 117, respectively. Each of the emulsion layer units is formed of one or more hydrophilic colloid layers including at least one silver halide emulsion layer. Overlying the emulsion layer units 115 and 117 are optional hydrophilic colloid protective overcoat layers 119 and 121, respectively. All of the hydrophilic colloid layers are permeable to processing solutions.

In use, the assembly is imagewise exposed to X-radiation. The X-radiation is principally absorbed by the intensifying screens 201 and 202, which promptly emit light as a direct function of x-ray exposure. Considering first the light emitted by screen 201, the light recording latent image forming emulsion layer unit 115 is positioned adjacent to this screen to receive the light which it emits. Because of the proximity of the screen 201 to the emulsion layer unit 115 only minimal light scattering occurs before latent image forming absorption occurs in this layer unit. Hence light emission from screen 201 forms a sharp image in emulsion layer unit 115.

However, not all of the light emitted by screen 201 is absorbed within emulsion layer unit 115. This remaining light, unless otherwise absorbed, will reach the remote emulsion layer unit 117, resulting in a highly unsharp image being formed in this remote emulsion layer unit. Both crossover reducing layers 111 and 113 are interposed between the screen 201 and the remote emulsion layer unit and are capable of intercepting and attenuating this remaining light. Both of these layers thereby contribute to reducing crossover exposure of emulsion layer unit 117 by the screen 201. In an exactly analogous manner the screen 202 produces a sharp image in emulsion layer unit 117, and the light absorbing layers 111 and 113 similarly reduce crossover exposure of the emulsion layer unit 115 by the screen 202.

Following exposure to produce a stored latent image, the radiographic element 100 is removed from association with the intensifying screens 201 and 202 and processed in a rapid access processor—that is, a processor, such as an RP-X-OMAT TM processor, which is capable of producing an image bearing radiographic element dry to the touch in less than 90 seconds. Rapid access processors are illustrated by Barnes et al, U.S. Pat. No. 3,545,971 and Akio et al, European published patent application 248,390.

As employed herein the term "low crossover" means reducing to less than 10 percent crossover of electromagnetic radiation of wavelengths longer than 300 nm capable of forming a latent image in the silver halide emulsion layer units. As indicated above, low crossover is achieved in part by absorption of light within the emulsion layer units and in part by the layers 111 and 113, which serve as crossover reducing means. In addition to having the capability of absorbing longer wavelength radiation during imagewise exposure of the emulsion layer units, the crossover reducing means must also have the capability of being decolorized in less than 90 seconds during processing, so that no visual hindrance is presented to viewing the superimposed silver images.

The crossover reducing means decreases crossover to less than 10 percent, preferably reduces crossover to less than 5 percent, and optimally less than 3 percent. However, it must be kept in mind that for crossover measurement convenience the crossover percent being referred to also includes "false crossover", apparent crossover that is actually the product of direct X-radiation absorption. That is, even when crossover of longer wavelength radiation is entirely eliminated, measured crossover will still be in the range of 1 to 2 percent, attributable to the X-radiation that is directly absorbed by the emulsion farthest from the intensifying screen. Taking false crossover into account, it is apparent that any radiographic element that exhibits a measured crossover of less than about 5 percent is in fact a "zero crossover" radiographic element. Crossover percentages are determined by the procedures set forth in Abbott et al, U.S. Pat. Nos. 4,425,425 and 4,425,426, incorporated herein by reference.

Once the exposure crossover between the emulsion layer units has been reduced to less than 10 percent (i.e., low crossover) the exposure response of an emulsion layer unit on one side of the support is influenced to only a slight extent by (i.e., essentially independent of) the level of exposure of the emulsion layer on the opposite side of the support. It is therefore possible to form two independent imaging records, one emulsion layer unit recording only the emission of the front intensifying screen and the remaining emulsion layer unit recording only the emission of the back intensifying screen during imagewise exposure to X-radiation.

Historically radiographic elements have been constructed to produce identical sensitometric records in the two emulsion layer units on the opposite sides of the support. The reason for this is that until practical low crossover radiographic elements were made available by Dickerson et al I and II, cited earlier, both emulsion layer units of a double coated radiographic element received essentially similar exposures, since both emulsion layer units were simultaneously exposed by both the front and back intensifying screens.

To provide a specific illustration, consider the performance of the radiographic element 100 converted to a high crossover radiographic element by eliminating the crossover reducing layers 111 and 113. In this instance the emulsion layer units 115 and 117 are each exposed by both the intensifying screens 201 and 202. Referring to FIG. 2, a typical overall characteristic curve A-B-C-D is produced by exposing a high crossover double coated radiographic element. The overall characteristic curve is the sum of two identical characteristic curves A'-B'-C'-D' produced by the individual emulsion layer units. The same individual characteristic curves are produced even when the front and back intensifying screens are varied in their emission intensities, since each emulsion layer unit is exposed by both intensifying screens and therefore receives essentially the same exposure.

Since image sharpness is not a feature that shows up in a characteristic curve, the same overall and individual emulsion layer unit characteristic curves can be produced by substituting a low crossover sensitometrically symmetric radiographic element, such as radiographic element 100 with identical emulsion layer units 115 and 117 and with the crossover reducing layers 111 and 113 present, provided front and back intensifying screens 201 and 202, having similar light emission properties, are employed.

In FIG. 2, a point at mid-scale between points A and C is labeled BONE and a point at mid-scale between points A' and C' is labeled BONE', indicating the optimum film exposure for bone imaging. BONE represents the composite bone image produced by the emulsion layer units on both sides of the support, while BONE' represents the bone image produced by only one of two identical emulsion layer units on opposite sides of the support. While the same characteristic curve can be obtained using either a dual coated radiographic element of either high or low crossover, the low crossover radiographic element produces a sharper BONE image, since unsharpness due to crossover has been minimized, if not eliminated.

However, neither of the characteristic curves shown in FIG. 2 produce a useful image of flesh, regardless of the crossover characteristics of the radiographic element. The reason is that the portion of the film exposed through flesh, indicated by the FLESH and FLESH' on the overall and individual characteristic curves, respectively, has in each instance received an exposure in excess of that required to produce a maximum density, indicated by points D and D'. In other words, reducing the exposure of the film by some increment reflecting flesh attenuation is insufficient to reduce exposure of the film to a level less than that indicated by points D and D', and, as a result, no reduction in film density is produced by this increment of exposure reduction.

In Dickerson and Bunch I and II as well as Bunch and Dickerson, each cited above, it is taught to employ a fast low contrast emulsion layer unit in combination with a slow high contrast emulsion layer unit in a low crossover double coated radiographic element to obtain a heart image while at the same time obtaining a sharp lung image. This combination is not useful for producing a sharp bone image, alone or in combination with a flesh image.

It is the discovery of this invention that a low crossover double coated radiographic element can be constructed to produce sharp bone images and useful flesh images by employing the combination of a relatively high contrast emulsion layer unit and a relatively low contrast emulsion layer unit. This requires that the relatively high contrast emulsion layer unit exhibit a higher photographic speed than the relatively low contrast emulsion layer unit and that the contrast of each emulsion layer unit and the difference in speed between the emulsion layer units be maintained within workable limits discussed in detail below.

It is an additional discovery of this invention that radiographic assemblies comprising various pairs of front and back intensifying screens with the low crossover sensitometrically asymmetric radiographic element can optimize the images of bones and the surrounding flesh of various densities in the body.

The BONE and FLESH imaging capability of the low crossover double coated radiographic elements of this invention can be appreciated by reference to FIG. 3. In FIG. 3 the overall characteristic curve $A^T$-$B^T$-$C^T$-$D^T$ of the radiographic element of the invention is similar to the overall characteristic curve A-B-C-D, except that point $D^T$ is not the maximum density point of the characteristic curve. As in curve A-B-C-D optimum BONE exposure remains at mid-scale between points $B^T$-$C^T$, allowing the same sharp BONE images to be obtained as in the FIG. 2 low crossover radiographic element. However, the FLESH exposure point is now located in a portion of the characteristic curve that shows a lower contrast (i.e., $\Delta D/\Delta E$). Because the FLESH image is in a lower contrast portion of the characteristic curve than the BONE image, the FLESH image is less sharp. From the radiologist's viewpoint this is an advantage, since sharp images also contain a large high frequency noise content that would be distracting in attempting an accurate BONE diagnosis from the image. The radiologist is provided with exactly the information sought in the overwhelming majority of BONE diagnoses, a sharp BONE image and a view of surrounding FLESH that shows its general location and density, but not all of its fine detail.

The characteristic curve $A^T$-$B^T$-$C^T$-$D^T$ is the composite of the individual characteristic curves $A^H$-$B^H$-$C^H$-$D^H$ and $A^L$-$B^L$ produced by a relatively higher contrast emulsion layer unit on one side of the support and a relatively lower contrast emulsion layer unit on the opposite side of the support of the low crossover radiographic element of the invention. The characteristic curve $A^H$-$B^H$-$C^H$-$D^H$ is qualitatively similar to curves A-B-C-D and A'-B'-C'-D' described above. Note that the ideal $BONE^H$ exposure level remains at mid-scale between points $B^H$-$C^H$, resulting in the $FLESH^H$ exposure level occurring beyond the maximum density exposure level $D^H$.

The characteristic curve $A^L$-$B^L$ is strikingly different from individual emulsion layer unit characteristic curves A'-B'-C'-D' and $A^H$-$B^H$-$C^H$-$D^H$. The location of $BONE^L$ on the $A^L$-$B^L$ characteristic curve is at a lower exposure level than point $A^L$, indicating that insufficient exposure has been received to produce a useful $BONE^L$ image. On the other hand, the $FLESH^L$ image lies to the right of point $B^L$ on a portion of the characteristic curve that exhibits sufficient contrast for useful imaging. In FIG. 3 the $A^L$-$B^L$ curve has not been extended to show a shoulder portion of the curve, since extended patient exposure to reach the shoulder portion of the $A^L$-$B^L$ curve will seldom, if ever, occur.

As shown in FIG. 3 the lower contrast curve makes no contribution to $BONE^T$ imaging while the higher contrast curve makes no contribution to $FLESH^T$ imaging. In practice it is recognized that the lower contrast curve may make some contribution to $BONE^T$ imaging, although this is not its primary imaging role, while the higher contrast curve can make some contribution to $FLESH^T$ imaging, although again this is not its primary imaging role and its contribution to $FLESH^T$ imaging will be too small to be serviceable in and of itself.

To realize the desired shape of characteristic curve $A^T$-$B^T$-$C^T$-$D^T$ capable of satisfying practical imaging requirements for most human imaging subjects, it is important that certain relationships of speed and contrast be incorporated into the individual emulsion layer units of the low crossover double coated radiographic elements of the invention.

Conventional double coated radiographic elements are sensitometrically symmetric. It is therefore customary to perform sensitometric measurements on the double coated element rather than on a single emulsion layer unit. To keep the sensitometric parameters of this invention comparable to customary measurements, individual emulsion layer unit speeds and contrasts are determined by coating the emulsion layer unit to be measured on both sides of a conventional transparent (usually blue tinted) film support and measuring speed and contrast at a reference overall density of 1.0, which includes any increment of density (typically less than 0.24) contributed by the film support. This is done to allow those skilled in the art to compare readily the numerical parameters recited to those they customarily employ in characterizing double coated radiographic elements. In the various plots of density versus log E for a particular example emulsion layer unit, each curve represents a single emulsion layer unit rather than a pair of identical emulsion layer units, since this permits the contribution of each emulsion layer unit to the overall characteristic curve to be more readily visually appreciated.

On average there is about a 0.6 log E exposure differential in the exposure of a radiographic element in areas receiving X-radiation penetrating bone and that penetrating flesh alone. The exposure differential will vary depending on the density of the bone and soft tissue structure to be imaged. Allowing for patient to patient variances as well as anatomical variances, it is generally contemplated that the difference in speed of the faster and slower emulsion layer units will be in the range of from 0.3 to 1.0 log E, preferably 0.4 to 0.8 log E.

The faster, higher contrast emulsion layer unit is contemplated to have a contrast in the range of from 2.0 to 4.0, preferably 2.5 to 3.5 while the slower, lower contrast emulsion layer unit is contemplated to have a contrast in the range of from 0.5 to 1.7, preferably 0.7 to 1.5. The faster, higher contrast emulsion layer unit is the back emulsion layer unit; the slower, lower contrast emulsion layer unit is the front emulsion layer unit. As herein employed the term "contrast" is the slope of the characteristic curve at a reference density of 1.0 and is not an average of contrasts over a range of densities.

As stated earlier, the radiographic assemblies of this invention will use the low crossover sensitometrically asymmetric radiographic elements in combination with various intensifying screen pairs which optimize the imaging of the various bone and surrounding soft tissue structures in the body. The various bone and surrounding soft tissue structures are grouped together into exam types. The main exam types in orthopedic imaging include the following:

1. Imaging of small bones which have little soft tissue coverage, such as hands and feet (the extremities). This exam type requires high resolution, but does not require a wide dynamic range.
2. Imaging of larger bones with greater soft tissue coverage, such as knees and shoulders. This exam type generally requires lower resolution and higher dynamic range than the imaging of small bones.
3. Imaging of Lateral Cervical Spine of the vertebral column for which it is essential to see all of the vertebra from C1-T7. This exam type requires imaging through little to a great amount of soft tissue coverage; therefore, the need for dynamic range is important.

These exam types will be referred to as "Extremity Imaging", "Imaging of Knees and Shoulders" and "Imaging of Lateral C-Spines", but it is understood that the imaging demands of these tests may be the same for other body parts and that the imaging assemblies described for each of the exam types can be used for other body parts.

Extremity Imaging is optimized by an assembly consisting of a pair of high resolution intensifying screens and the previously described low crossover sensitometrically asymmetric radiographic element. The intensifying screens produce minimal asymmetry of light output. The back fast high contrast emulsion layer unit and the front slow low contrast emulsion layer unit are in contact with high resolution intensifying screens. The photicity ratio of the back emulsion layer unit-back intensifying screen to the front emulsion layer unit-front intensifying screen is between 2 and 5. Photicity is the integrated product of (1) the total emission of the screen over the wavelength range to which the emulsion layer unit is responsive, (2) the sensitivity of the emulsion layer unit over this emission range, and (3) the transmittance of radiation between the screen and its adjacent emulsion layer unit over this emission range. Transmittance is typically near unity and can in this instance be ignored. Photicity is discussed in greater detail in Mees, *The Theory of the Photographic Process, 3rd Ed.*, Macmillan, 1966, at page 462, here incorporated by reference.

Figure 5:
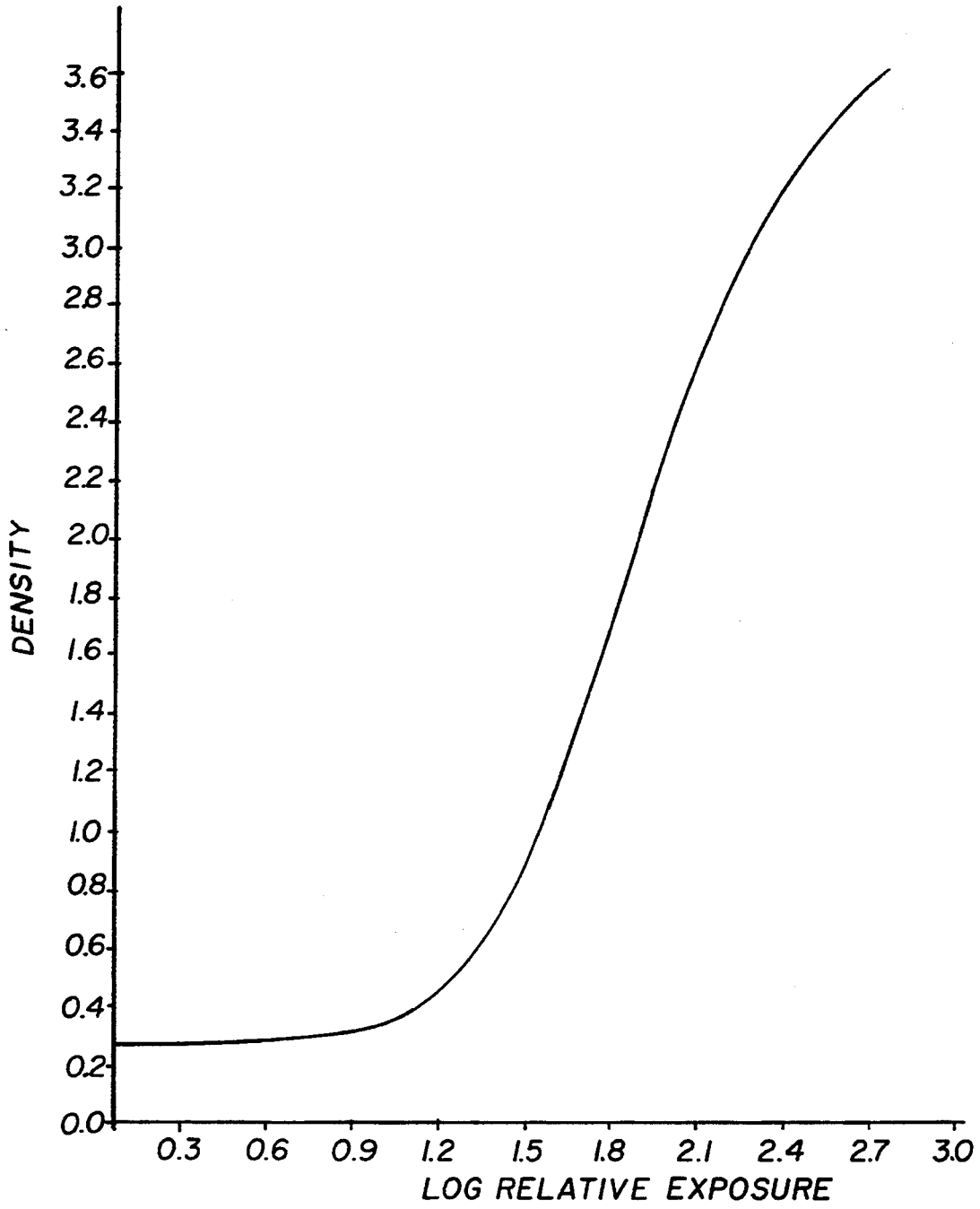
FIG. 5 represents the overall characteristic curve of the imaging assembly described in Example Assembly 2, consisting of a sensitometrically asymmetric low crossover double coated radiographic element and front and back intensifying screens corresponding to high resolution intensifying screens.

This assembly records the very fine detail of bony trabeculae and useful images of the surrounding soft tissue. The resulting characteristic curve shape for this imaging assembly has moderate to low dynamic range as seen in FIG. 5.

Figure 4:
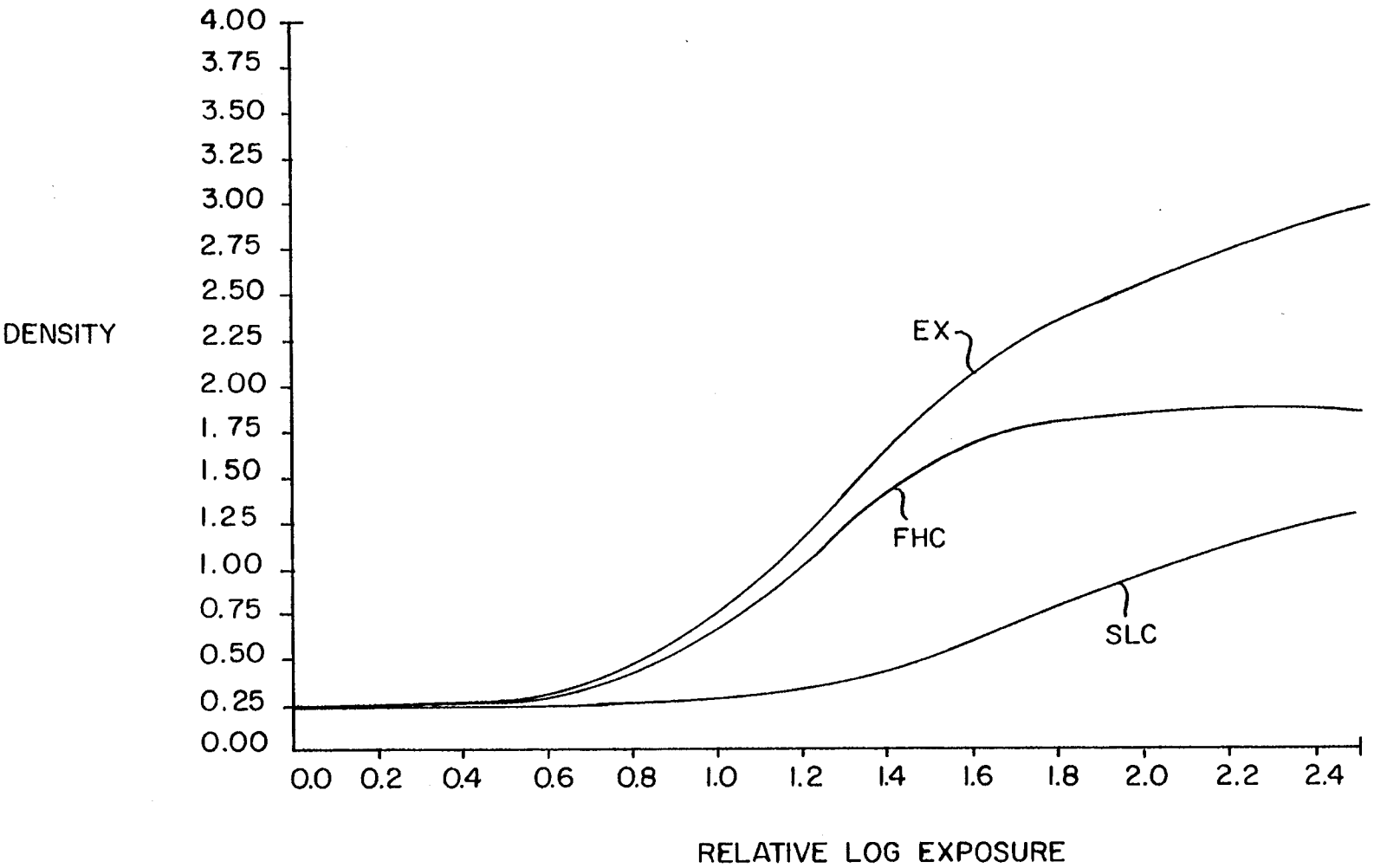
FIG. 4 represents the overall and individual emulsion layer unit characteristic curve of the imaging assembly described in Example Assembly 1, consisting of a sensitometrically asymmetric low crossover double coated radiographic element, a front intensifying screen corresponding to a high resolution intensifying screen and a back intensifying screen corresponding to a medium resolution intensifying screen.

Imaging of Knees and Shoulders is optimized by an assembly of a front high resolution intensifying screen and a back medium resolution intensifying screen and the previously described low crossover sensitometrically asymmetric radiographic element. This pair of screens provides a moderate degree of light output asymmetry, lower resolution and greater dynamic range than the screens used in Extremity Imaging. The high resolution front screen is next to and/or in contact with the slow low contrast emulsion layer unit of the radiographic element and the medium resolution back screen is next to and/or in contact with the fast high contrast emulsion layer unit in the assembly. The ratio of the photicity of the back emulsion layer unit-back intensifying screen to the front emulsion layer unit-front intensifying screen is between 5 and 9. The combination of moderately asymmetrical screens and a low crossover sensitometrically asymmetric radiographic element results in the recording of moderately detailed images of bone and useful images of the surrounding soft tissue. The resulting characteristic curve has moderate to high dynamic range as seen in FIG. 4.

Figure 7:
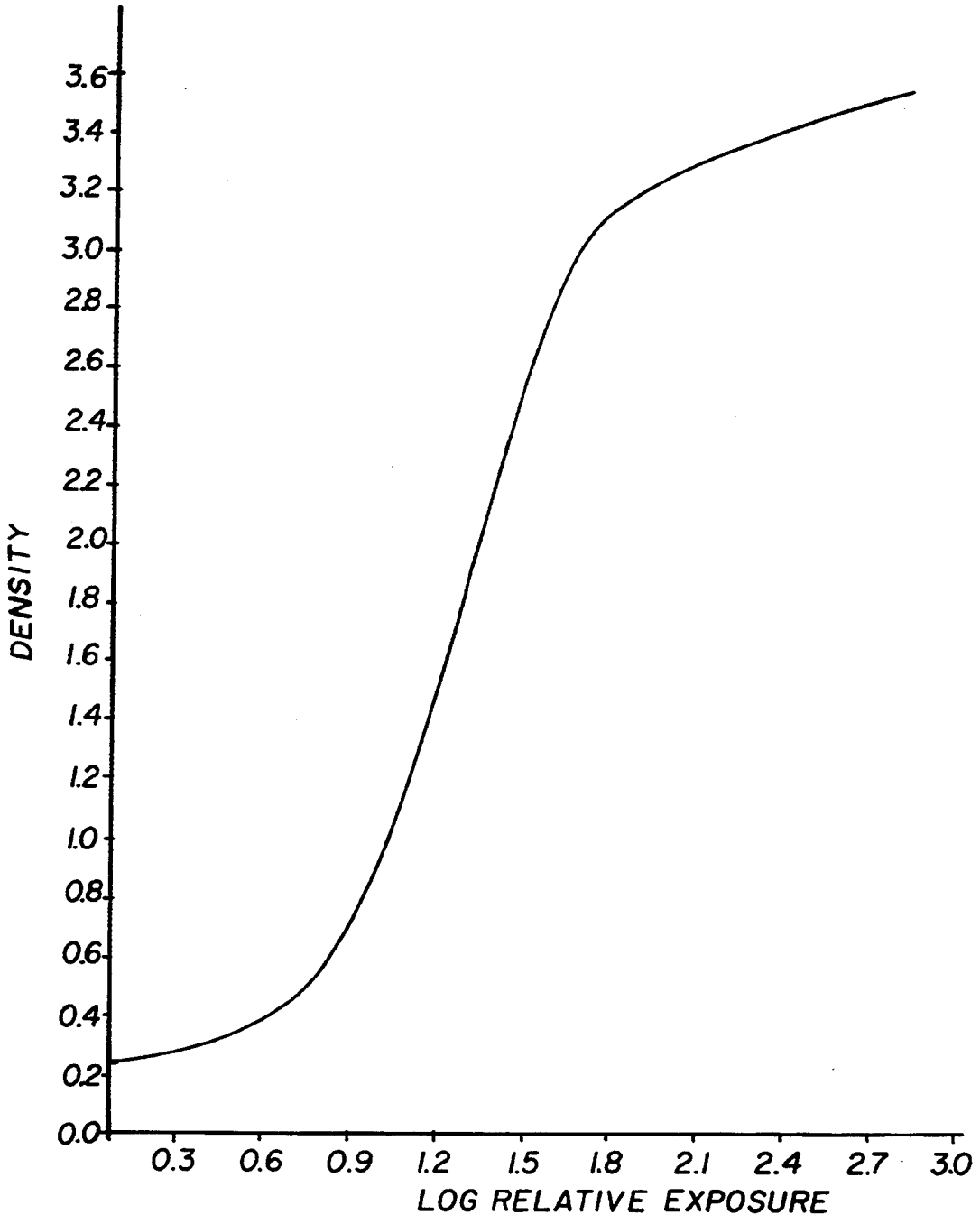
FIG. 7 represents the overall characteristic curve of the imaging assembly described in Comparative Assembly C1, consisting of a high crossover sensitometrically symmetrical high contrast radiographic element and front and back intensifying screens corresponding to medium resolution intensifying screens.

Imaging of Lateral C-Spines is optimized by an assembly of a front high resolution intensifying screen and a low resolution intensifying screen and the previously described low crossover sensitometrically asymmetric radiographic element. This pair of screens provides the most asymmetric light output and the greatest dynamic range in comparison to the screens used for Extremity Imaging and Imaging of Knees and Shoulders. Although this assembly provides the lowest resolution, the very wide dynamic range required for this difficult exam is achieved. The high resolution front screen is next to and/or in contact with the slow low contrast emulsion layer unit of the radiographic element and a low resolution (high speed) back screen is next to and/or in contact with the fast high contrast emulsion layer unit. The photicity ratio of the back emulsion layer unit-back intensifying screen to the front emulsion layer unit-front intensifying screen is between 9 and 16. The combination of the high and low resolution screens and a low crossover sensitometrically asymmetric radiographic element results in the recording of useful images of bone and soft tissue. The resulting characteristic curve has low to high dynamic range as seen in FIG. 7.

Thus, a single low-crossover sensitometrically asymmetric radiographic element can be combined with various pairs of intensifying screens to provide the resolution and dynamic range that satisfies a wide range of exam types in orthopedic radiography.

High resolution intensifying screens are screens which possess an MTF greater than 0.5 at 2 cycles/mm and/or standardized relative emissions between 50 to 150, preferably about 70 to 125. The method of measuring the MTF and the standardized relative emissions are described below. Examples of commercially available high resolution intensifying screens are Kodak Lanex TM Fine or Kodak Min-R medium screens.

Medium resolution intensifying screens are screens which possess an MTF between 0.3 and 0.5 at 2 cycles/mm and/or standardized relative emissions between about 150 and 450, preferably about 250 and 400. The method of measuring the MTF and the standardized relative emissions are described below. Examples of commercially available medium resolution intensifying screens are Kodak Lanex TM Medium, or Kodak Lanex TM Regular intensifying screens.

Low resolution intensifying screens, that is fast screens, are screens which possess an MTF less than 0.3 at 2 cycles/mm and/or standardized relative emissions between about 450 and 800, preferably about 550 and 700. The method of measuring the MTF and the standardized relative emissions are described below. Examples of commercially available low resolution intensifying screens are Kodak Lanex TM Fast Back intensifying screens.

The MTF's of the screens were measured following the procedure of Doi et al, "MTF's and Wiener Spectra of Radiographic Screen-Film Systems, U.S. Department of Health and Human Services, pamphlet FDA 82-8187, modified as described in Luckey et al U.S. Pat. No. 4,710,637. However, since Luckey et al measured MTF's at low energy levels typical of mammography, the following changes were made to obtain MTF's corresponding to more commonly employed energy levels: A 3-phase, 12-pulse generator, with a tungsten-target X-ray tube, was employed at 90 kVp, with 3 mm aluminum filtration. The inherent filtration of the X-ray tube itself was approximately 1 mm aluminum equivalent, bringing the total X-ray beam filtration up to approximately 4 mm aluminum equivalent.

The standardized relative emissions of electromagnetic radiation longer than 370 nm in wavelength for the intensifying screens were determined as follows: (The screens exhibited no significant emissions at wavelengths between 300 and 370 nm.)

The X-radiation response of each screen was obtained using a tungsten target X-ray source in an XRD 6 TM generator. The X-ray tube was operated at 70 kVp and 30 mA, and the X-radiation from the tube was filtered through 0.5 mm Cu and 1 mm Al filters before reaching the screen.

The emitted light was detected by a Princeton Applied Research Model 1422/01 TM intensified diode array detector coupled to an Instruments SA Model HR-320 TM grating spectrograph. This instrument was calibrated to within ±0.5 nm with a resolution of better than 2 nm (full width at half maximum). The intensity calibration was performed using two traceable National Bureau of Standards sources, which yielded an arbitrary intensity scale proportional to Watts/nm/cm$^2$. The total integrated emission intensity from 250 to 700 nm was calculated on a Princeton Applied Research Model 1460 OMA III TM optical multichannel analyzer by adding all data points within this region and multiplying by the bandwidth of the region.

Actual emission levels were converted to standardized relative emission levels by dividing the emissions of each screen by the emissions of the high resolution screen, Screen Z which is described below, and multiplying by 100.

Another useful parameter to determine which screens will function in the assemblies of this invention is the emission ratios between the front and back screens. For Extremity Imaging the preferred range of emission ratios between the front and back intensify screens is 1.0 to between 0.5 and 2.0, respectively. For Imaging of Knees and Shoulders, the preferred range of emission ratios between the front and back intensifying screens is 1.0 to between 2.0 and 5.0, respectively. For Imaging of the Lateral C-Spines, the preferred range of emission ratios between the front and back intensifying screens is 1.0 to greater than 5.0.

The intensifying screens can be made by any known method, comprising any of the materials known for incorporation into the screens as long as they possess the standardized relative emissions, MTF, and/or ratio of emissions between front and back screens as specified above. For examples of methods and materials used in phosphor screens see Dickerson, et al I and II, and Dickerson and Bunch I and II. Additionally, from the features noted above the radiographic elements and intensifying screens of this invention can take any convenient conventional form. Features and details of features not specifically discussed preferably correspond to those disclosed by Dickerson et al I and II, Dickerson and Bunch I and II and Bunch and Dickerson, U.S. Pat. Nos. 4,434,226; 4,439,520; 4,414,304; 4,425,501; 4,520,098; 5,021,327; 2,303,942; 4,225,653; 3,418,246; 3,418,247; 3,725,704; 2,729,604; 3,617,743; 3,974,389; 3,591,516; 3,607,770; 2,502,529; 2,887,379; 3,617,285; 3,743,833; 4,259,588 and *Research Disclosure,* Vol. 154, February 1977, Item 15444 and Vol. 182, June 1979, Item 18431 and Item 17643, all incorporated herein by reference.

EXAMPLES

The invention can be better appreciated by reference to the following specific examples:

Radiographic Exposures

Assemblies consisting of a double coated radiographic element sandwiched between a pair of intensifying screens were in each instance exposed as follows:

The assemblies were exposed using an intensity scale X-ray sensitometer of the type described by A. G. Haus, K. Rossman, C. Vyborny, P. B. Hoffer and K. Doi, "Sensitometry in Diagnostic Radiology, Radiation Therapy, and Nuclear Medicine", *J. Appl. Photog. Eng.,* vol. 3, pp. 114–124 (1977). Exposure conditions were as follows: 80 KVp X-radiation (constant potential), total filtration consisting of 3 mm beryllium +0.5 mm copper +2.2 mm aluminum; 7.5 mm aluminum half-value layer; 1.5 mA, 0.11 sec exposure.

Processing

The radiographic elements were processed in 90 seconds in a commercially available Kodak RP X-Omat (Model 6AW) TM rapid access processor as follows:

| | |
|---|---|
| development | 20 seconds at 35° C., |
| fixing | 12 seconds at 35° C., |
| washing | 8 seconds at 35° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employs the following fixing composition:

| | |
|---|---|
| Ammonium thiosulfate, 60% | 260.0 g |
| Sodium bisulfate | 180.0 g |
| Boric acid | 25.0 g |
| Acetic acid | 10.0 g |
| Aluminum sulfate | 8.0 g |
| Water to 1 liter at pH 3.9 to 4.5. | |

Sensitometry

Optical densities are expressed in terms of diffuse density as measured by an X-rite Model 310 TM densitometer, which was calibrated to ANSI standard pH 2.19 and was traceable to a National Bureau of Standards calibration step tablet. The characteristic curve (density vs. log E) was plotted for each radiographic element processed. Average contrast in each instance was determined from the characteristic curve at densities of 0.25 and 2.0 above minimum density.

Screens

The following intensifying screens were employed:

Screen W

This screen has a composition and structure corresponding to that of a commercial, high speed, low resolution screen. It consisted of a terbium activated gadolinium oxysulfide phosphor having a median particle size of 8 to 9 mm coated on a white pigmented polyester support in a Permuthane TM polyurethane binder at a total phosphor coverage of 13.3 g/dm$^2$ at a phosphor to binder ratio of 19:1.

Screen X

This screen has a composition and structure corresponding to that of a commercial, general purpose, medium resolution screen. It consisted of a terbium activated gadolinium oxysulfide phosphor having a median particle size of 7 μm coated on a white pigmented polyester support in a Permuthane TM polyurethane binder at a total phosphor coverage of 7.0 g/dm$^2$ at a phosphor to binder ratio of 15:1.

Screen Z

This screen has a composition and structure corresponding to that of a commercial, high resolution screen. It consisted of a terbium activated gadolinium oxysulfide phosphor having a median particle size of 5 μm coated on a blue tinted clear polyester support in a Permuthane TM polyurethane binder at a total phosphor coverage of 3.4 g/dm$^2$ at a phosphor to binder ratio of 21:1 and containing 0.0015% carbon.

Screen Emissions

The standardized relative emissions of electromagnetic radiation longer than 370 nm in wavelength for the intensifying screens were measured as described above. The standardized relative emissions were as follows:

Screen W=625
Screen X=349
Screen Z=100

(The screens exhibited no significant emissions at wavelengths between 300 and 370 nm.)

Modulation Transfer Factor of Screens

The MTF's of the screens, determined as described above, were as follows:

Screen W=0.208
Screen X=0.330
Screen Z=0.734

Example Element 1 (Em.FHC)LXOA(Em.SLC)

Radiographic Element 1 was a double coated radiographic element exhibiting near zero crossover.

Radiographic Element 1 was constructed of a low crossover support composite (LXO) consisting of a blue-tinted transparent polyester film support coated on each side with a crossover reducing layer consisting of gelatin (48 mg/ft$^2$) containing 22 mg/ft$^2$ of a crossover control dye. The crossover control dye was Dye 59 from Bunch and Dickerson, U.S. Pat. No. 5,021,327, which is incorporated herein by reference.

Slow low contrast (SLC) and fast high contrast (FHC) emulsion layers were coated on opposite sides of the support over the crossover reducing layers. Both emulsions were green-sensitized high aspect ratio tabular grain silver bromide emulsions, where the term "high aspect ratio" is employed as defined by Abbott et al U.S. Pat. No. 4,425,425 to require that at least 50 percent of the total grain projected area be accounted for by tabular grains having a thickness of less than 0.3 μm and having an average aspect ratio of greater than 8:1. The slow low contrast emulsion was a 1:1 (silver ratio) blend of a first emulsion which exhibited an average grain diameter of 2.0 μm and an average grain thickness of 0.13 μm and a second emulsion which exhibited an average grain diameter of 1.2 μm and an average grain thickness of 0.13 μm The fast high contrast emulsion exhibited an average grain diameter of 2.4 μm and an average grain thickness of 0.12 μm. The fast high contrast emulsion was monodispersed, exhibiting both thickness and diameter coefficients of variation of less than 10%. Both the fast high contrast and slow low contrast emulsions were spectrally sensitized with 400 mg/Ag mol of anydro-5,5-dichloro-9-ethyl-3,3'-bis(3-sulfopropyl)oxacarbocyanine hydroxide, followed by 300 mg/Ag mol of potassium iodide. The slow low contrast emulsion was coated at a silver coverage of 1.6 g/m$^2$ and a gelatin coverage of 3.3 g/m$^2$. Protective gelatin layers (0.7 g/m$^2$) were coated over the emulsion layers. A red absorbing dye (44 mg/m$^2$) was added to the protective overcoat of the high contrast side to provide visual identification of the respective sides under safelight conditions. Each of the gelatin containing layers were hardened with bis(vinylsulfonylmethyl) ether at 1% of the total gelatin.

When Element 1 was tested for crossover as described by Abbott et al U.S. Pat. No. 4,425,425, it exhibited a crossover of 2%.

When coated as described above, but symmetrically, with Emulsion SLC coated on both sides of the support and Emulsion FHC omitted, using a pair of X screens, Emulsion SLC exhibits a contrast of 1.7 at an overall density of 1.0. Similarly, when Emulsion FHC is coated symmetrically with Emulsion SLC omitted, using a pair of X screens, Emulsion FHC exhibits a contrast of 2.9 at an overall density of 1.0. The speed difference in the two coatings at an overall density of 1.0 is 0.7 log E.

Example Assembly 1

Radiographic Assembly 1 consisted of Element 1, the front intensifying screen was high resolution Screen Z and the back intensifying screen was medium resolution Screen X. The front screen was next to the SLC emulsion, and the back screen was next to the FHC emulsion of the radiographic element.

When Assembly 2 was exposed by X-rays, the individual and overall characteristic curves shown in FIG. 4 were obtained. FHC on FIG. 4 designates the back screen-emulsion layer unit combination, SLC designates the front screen-emulsion layer unit combination, and EX designates the overall characteristic curve. FIG. 4 shows that bone exposure can occur anywhere in the density range of about 0.5 to 1.25 and the useful flesh exposure density range is between about 1.5 to 2.5. Thus Element 1 has the capability of obtaining sharp images of bone tissue and useful images of the surrounding flesh and Assembly 2 has the capability of obtaining moderate resolution and moderate contrast and reasonable exposure latitude appropriate for Imaging of Knees and Shoulders.

Example Assembly 2

Radiographic Assembly 1 consisted of Element 1 and front and back intensifying screens. The front and back intensifying screens were both high resolution screens, Screen Z.

When Emulsions FHC and SLC of the radiographic element were exposed by high resolution screens, that is, the front and back intensifying screens were Screen Z the overall characteristic curve shown in FIG. 5 was obtained. The overall characteristic curve shows that detailed images of bone can be recorded in the density range of about 0.5 to 1.25 and the surrounding soft tissue can be recorded in the density range of about 1.5 to 2.5. Thus Assembly 1 has the capability of obtaining sharp images of the small bones and useful images of the low density surrounding soft tissue.

Example Assembly 3

Radiographic Assembly 3 consisted of the Element 1 and the front and back intensifying screens were high resolution Screen Z and low resolution (high speed) Screen W, respectively. The front screen was next to the SLC emulsion, and the back screen was next to the FHC emulsion of the radiographic element.

Figure 6:
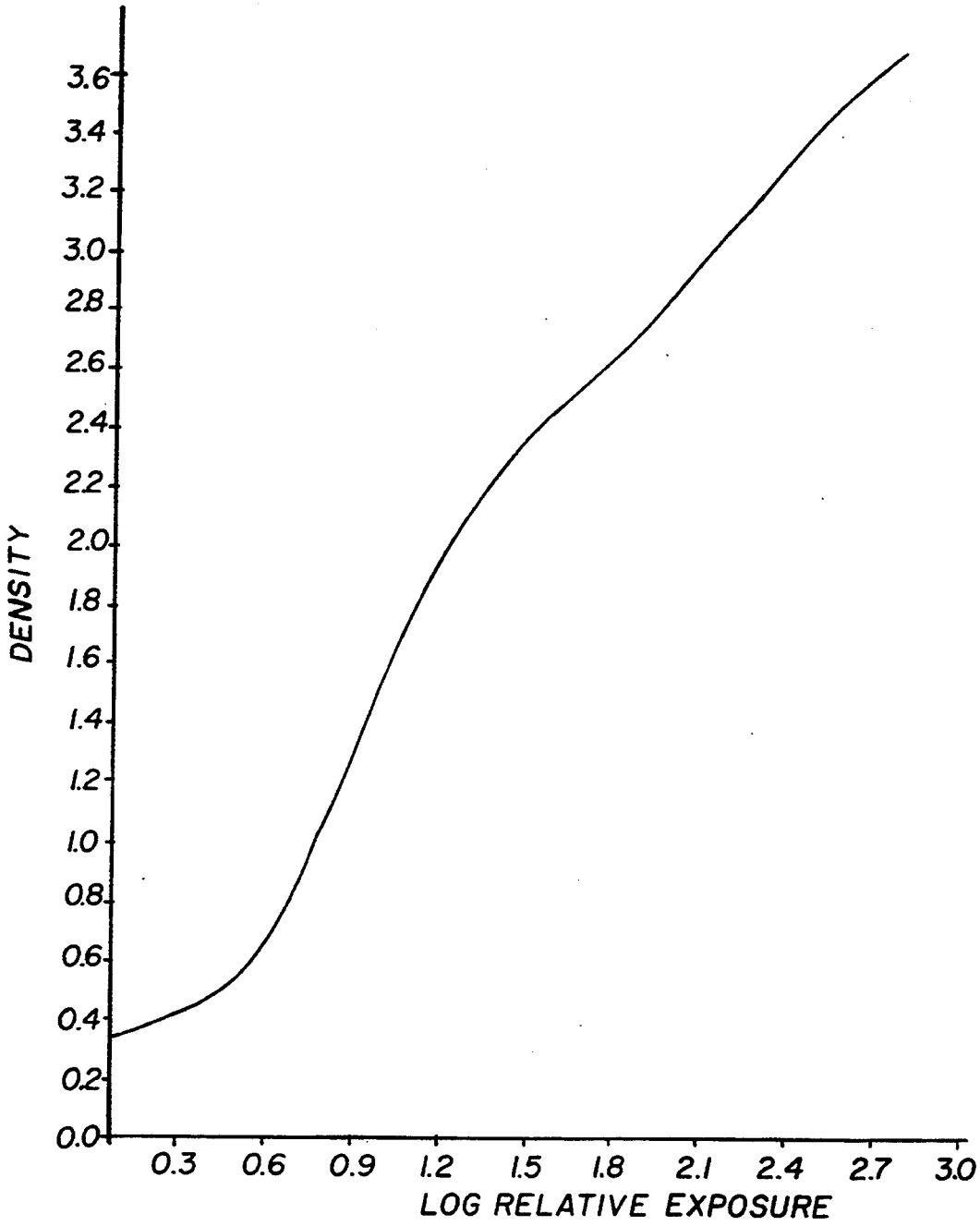
FIG. 6 represents the overall characteristic curve of the imaging assembly described in Example Assembly 3, consisting of a sensitometrically asymmetric low crossover double coated radiographic element, a front intensifying screen corresponding to a high resolution intensifying screen and a back intensifying screen corresponding to a low resolution intensifying screen.

When Assembly 3 was exposed by X-rays, the overall characteristic curve shown in FIG. 6 was obtained. The overall characteristic curve shows that detailed images of bones can be recorded in the density range of about 0.5 to 1.25 and the surrounding flesh can be recorded in the density range of about 1.5 to 2.5. Thus Assembly 3 has the capability of obtaining moderate resolution with very wide exposure latitude appropriate for Imaging of the Lateral C-Spines.

Comparative Element C1 (Em.FHC)HXOA(Em.SLC)

To further demonstrate the advantages of the invention, a control radiographic element was constructed similarly as Element 1, described above, except that the crossover control dye was omitted.

When the Elements C1 and 1 were identically exposed and processed as described above for Assembly 1, it was observed that Element 1 exhibited a larger useful overall dynamic range of exposure and exhibited higher contrast in the density regions 0.5 to 1.25 in which bone images are viewed. Overall dynamic range is the difference in exposure levels between the limit of minimum bone densities (0.5) and the limit of maximum flesh densities (2.5).

Comparative Assembly C1

The advantages of the invention are further demonstrated by comparison of Assemblies 1 to 3 to Assembly C1. Assembly C1 consisted of radiographic element (Em.HC)HXO(Em.HC), and a pair of medium resolution front and back intensifying screens, Screen X. The radiographic element (Em.HC)HXO(Em.HC) had symmetrical high contrast emulsion layers which comprised a green sensitized high aspect ratio tabular grain silver bromide emulsion. The emulsion was coated with 209 mg/ft$^2$ Ag and exhibited an average grain diameter of 2.1 μm and an average grain thickness of 0.13 μm. The emulsion was spectrally sensitized with 400 mg/Ag mol of anhydro-5,5-dichloro-9-ethyl-3,3'-bis(3-sulfopropyl)-oxacarbocyanine hydroxide, followed by 300 mg/Ag mol of potassium iodide. The emulsion layers were each coated with a silver coverage of 2.10 g/m$^2$ and a gelatin coverage of 265 mg/ft$^2$. Protective gelatin layers (70 mg/ft$^2$) were coated over the emulsion layers. Each of the gelatin containing layers were hardened with bis(-vinylsulfonylmethyl) ether at 1% of the total gelatin.

When the element, (Em.HC)HXO(Em.HC), was tested for crossover as described by Abbott et al, U.S. Pat. No. 4,425,425, it exhibited a crossover of 24%.

When the Assembly C1 was exposed, it produced the characteristic curve shown in FIG. 7. Assembly C1 provides good resolution and contrast for bone imaging (although the image is not sharp due to the absence of the crossover preventing layer), but this Assembly would not provide sufficient exposure latitude for soft tissue imaging, because it does not provide enough dynamic range to record optimum images of the soft tissue. This is shown by a comparison of the characteristic curves for Assembly 1 (FIG. 4) and Assembly C1 (FIG. 7). For a soft tissue density range of 1.5 to 2.5, the change in log relative exposure was 0.65 on FIG. 4, whereas for the same density range on FIG. 7, the change in log relative exposure was 0.3. Therefore, Assembly 1 provides more than twice the dynamic range for flesh imaging than Assembly C1 which means Assembly 1 is better suited for obtaining useful images of the surrounding flesh.

Comparative Assembly C2

The advantages of the invention are further demonstrated by comparative example, Assembly C2. Assembly C2 consisted of radiographic element (Em.LC)HXO(Em.LC) and medium resolution front and back intensifying screens, Screen X. The radiographic element had symmetrical low contrast emulsion layers.

The radiographic element (Em.LC)HXO(Em.LC) was constructed of a blue-tinted polyester support. The emulsion employed was a green-sensitized polydispersed silver bromide emulsion. The emulsion was a blend of three high aspect ratio tabular grain silver bromide emulsions having mean grain diameters of 3.5, 2.1 and 1.2 μm and each having a mean grain thickness of about 0.13 μm. Each emulsion was spectrally sensitized with 400 mg/Ag mol of anhydro-5,5-dichloro-9-ethyl-3,3'-bis(3-sulfopropyl-) oxacarbocyanine hydroxide, followed by 300 mg/Ag mol of potassium iodide. The emulsion layers were each coated with a silver coverage of 1.98 g/m$^2$. Protective gelatin layers (70 mg/ft$^2$) were coated over the emulsion layers. Each of the gelatin containing layers were hardened with bis(-vinylsulfonylmethyl) ether at 1% of the total gelatin.

When the element used in Assembly C2 was tested for crossover as described by Abbott et al, U.S. Pat. No. 4,425,425, it exhibited a crossover of 26%.

Figure 8:
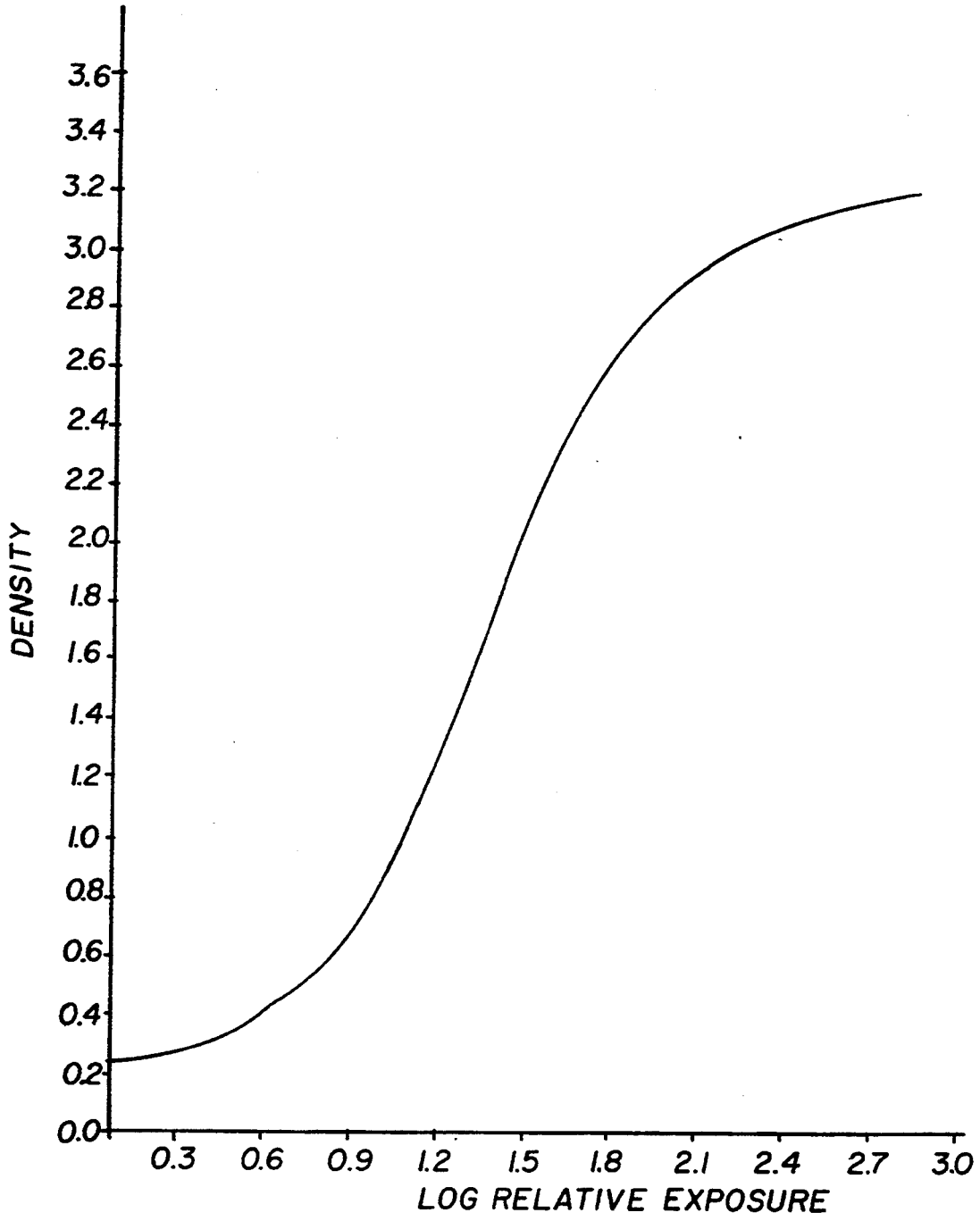
FIG. 8 represents the overall characteristic curve of the imaging assembly described in Comparative Assembly C2, consisting of a high crossover sensitometrically symmetrical low contrast radiographic element and front and back intensifying screens corresponding to medium resolution intensifying screens., In the characteristic curves of FIGS. 2 and 3, presented as aids to visualization of significant features of the prior art and the invention rather than as characteristic curves produced by measurement of actual emulsions, the density of the support, being irrelevant, has been assigned a value of zero and the minimum density of each emulsion layer unit has been exaggerated for ease of visualization. In the characteristic curve(s) of FIG.(s) 4, 5, 6, 7, and 8 based on actual measurements, the minimum density shown is principally attributable to the density of the conventional blue tinted transparent film support, while the minimum density of the individual emulsion layer units in each instance fell below the limits of plotting accuracy.

When Assembly C2 was exposed to x-radiation, it produced the characteristic curve in FIG. 8. Assembly C2 provides medium exposure latitude for imaging soft tissue (although the image was not sharp due to the absence of the crossover preventing layer), and low contrast for bone imaging. The benefits of the element and assemblies of this invention is shown by comparing Assembly 1 (FIG. 4) to Assembly C2 (FIG. 8). For Assembly 1, the change in log relative exposure over the density a range appropriate for bone imaging (0.5 to 1.25) is 0.39 compared to 0.45 for the same density range for Assembly C2. A smaller change in log relative exposure indicates higher contrast appropriate for obtaining bone imaging; therefore, Assembly 1 provides better bone imaging capability. Also, comparing the dynamic range for soft tissue imaging, Assembly C2 has a 0.43 change in the log relative exposure and Assembly 1 has 0.65 change in the log relative exposure over the density range of 0.5 to 1.25. For soft tissue imaging a larger dynamic range is preferred which Assembly 1 provides. Therefore, Assembly 1 can better provide optimum images of bones and useful images of the surrounding soft tissue as compared to Assembly C2.

The invention has been described in detail with particular reference to preferred embodiments thereof, but it will be understood that variations and modifications can be effected within the spirit and scope of the invention.

What is claimed is:

1. A radiographic element intended to produce relatively sharp images of bone and useful images of surrounding tissue when exposed to x-radiation between a back intensifying screen and a front intensifying screen, comprised of a transparent film support, front and back silver halide emulsion layer units coated on opposite sides of the film support, and means for reducing to less than 10 percent crossover of electromagnetic radiation of wavelengths longer than 300 nm capable of forming a latent image in the silver halide emulsion layer units, said crossover reducing means being decolorized in less than 30 seconds during processing of said emulsion layer units, wherein, at a density of 1.0, said back silver halide emulsion layer unit exhibits a speed exceeding by from 0.3 to 1.0 log E that of said front silver halide emulsion layer unit, said back silver halide emulsion layer unit exhibits a contrast in the range of from 2.0 to 4.0, and said front silver halide emulsion layer unit exhibits a contrast in the range of from 0.5 to 1.7, the speed and contrast of the back silver halide emulsion layer unit being determined with the back silver halide emulsion layer unit replacing the front silver halide emulsion layer unit to provide an arrangement with silver halide emulsion layer units corresponding to the back silver halide emulsion layer unit present on both sides of the transparent support and the speed and contrast of the front silver halide emulsion layer unit being determined with the front silver halide emulsion layer unit replacing the back silver halide emulsion layer unit to provide an arrangement with silver halide emulsion layer units corresponding to the front silver halide emulsion layer unit present on both sides of the transparent support.

2. A radiographic element according to claim 1 wherein said crossover reducing means decreases crossover to less than 5 percent.

3. A radiographic element according to claim 2 wherein said crossover reducing means decreases crossover to less than 3 percent.

4. A radiographic element according to claim 1 wherein the speed difference between the back and front silver halide emulsion layer units is in the range of from 0.4 to 0.8 log E.

5. A radiographic element according to claim 1 wherein the back silver halide emulsion layer unit exhibits a contrast in the range of from 2.5 to 3.5.

6. A radiographic element according to claim 1 wherein the front silver halide emulsion layer unit exhibits a contrast in the range of from 0.7 to 1.5.

7. An imaging assembly intended to produce relatively sharp images of bone and useful images of surrounding tissue when exposed to X-radiation comprising:

a front intensifying screen, a back intensifying screen, and a radiographic element comprised of a transparent film support, front and back silver halide emulsion layer units coated on opposite sides of the film support with said front and back emulsion layer units located adjacent to the front and back intensifying screens, respectively, means for reducing to less than 10 percent crossover of electromagnetic radiation of wavelengths longer than 300 nm capable of forming a latent image in the silver halide emulsion layer units, said crossover reducing means being decolorized in less than 30 seconds during processing of said emulsion layer units, wherein, at a density of 1.0, said back silver halide emulsion layer unit exhibits a speed exceeding by from 0.3 to 1.0 log E that of said front silver halide emulsion layer unit, said back silver halide emulsion layer unit exhibits a contrast in the range of from 2.0 to 4.0, and said front silver halide emulsion layer unit exhibits a contrast in the range of from 0.5 to 1.7 the speed and contrast of the back silver halide emulsion layer unit being determined with the back silver halide emulsion layer unit replacing the front silver halide emulsion layer unit to provide an arrangement with identical silver halide emulsion layer units present on both sides of the transparent support and the speed and contrast of the front silver halide emulsion layer unit being determined with the front silver halide emulsion layer unit replacing the back silver halide emulsion layer unit to provide an arrangement with identical silver halide emulsion layer units present on both sides of the transparent support.

8. An imaging assembly according to claim 7, wherein said front and back intensifying screens have standardized relative emissions between about 50 and 150.

9. An imaging assembly according to claim 7, wherein said front and back intensifying screens have standardized relative emissions between about 70 and 125.

10. An imaging assembly according to claim 7, wherein said front intensifying screen has standardized relative emissions between about 50 and 150 and said back intensifying screen has standardized relative emissions between about 150 and 450.

11. An imaging assembly according to claim 7, wherein said front intensifying screen has standardized relative emissions between about 70 and 125, and said back intensifying screen has standardized relative emissions between about 250 and 400.

12. An imaging assembly according to claim 7, wherein said front intensifying screen has standardized relative emissions between about 50 and 150, and said back intensifying screen has standardized relative emissions between about 450 and 800.

13. An imaging assembly according to claim 7, wherein said front intensifying screen has standardized relative emissions between about 70 and 125 and said back intensifying screen has standardized relative emissions between about 550 and 700.

14. An imaging assembly according to claim 7, wherein said front and back intensifying screens have a Modulation Transfer Function greater than 0.5 at 2 cycles/mm.

15. An imaging assembly according to claim 7, wherein said front intensifying screen has a Modulation Transfer Function greater than 0.5 at 2 cycles/mm and said back intensifying screen has a Modulation Transfer Function between 0.3 and 0.5 at 2 cycles/mm.

16. An imaging assembly according to claim 7, wherein said front intensifying screen has a Modulation Transfer Function greater than 0.5 at 2 cycles/mm, and said back intensifying screen has a Modulation Transfer Function less than 0.3 at 2 cycles/mm.

17. An imaging assembly according to claim 7, wherein the range of emission ratios between said front and back intensifying screens is 1.0 to between 0.5 and 2.0, respectively.

18. An imaging assembly according to claim 7, wherein the range of emission ratios between said front and back intensifying screens is 1.0 to between 2.0 and 5.0, respectively.

19. An imaging assembly according to claim 7, wherein the range of emission ratios between said front and back intensifying screens is 1.0 to greater than 5.0.

20. An imaging assembly according to claim 7, wherein the photicity ratio of the back emulsion layer unit-back intensifying screen to front emulsion layer unit-front intensifying screens is between 2 and 5.

21. An imaging assembly according to claim 7, wherein the photicity ratio of the back emulsion layer unit-back intensifying screen to front emulsion layer unit-front intensifying screen is between 5 and 9.

22. An imaging assembly according to claim 7, wherein the photicity ratio of the back emulsion layer unit-back intensifying screen to front emulsion layer unit-front intensifying screen is between 9 and 16.

* * * * *